US007259342B2

(12) United States Patent
Lin et al.

(10) Patent No.: US 7,259,342 B2
(45) Date of Patent: Aug. 21, 2007

(54) NOISE REDUCTION KEY STRUCTURE

(75) Inventors: San-Feng Lin, Taipei (TW); Kun-Chin Chiu, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 11/491,135

(22) Filed: Jul. 24, 2006

(65) Prior Publication Data

US 2007/0084702 A1 Apr. 19, 2007

(30) Foreign Application Priority Data

Oct. 18, 2005 (TW) ..... 94136400 A

(51) Int. Cl.
*H01H 13/00* (2006.01)

(52) U.S. Cl. ..... 200/512; 200/302.1; 200/302.2; 200/341

(58) Field of Classification Search ..... 200/5 A, 200/406, 512, 516, 517, 520, 302.1, 302.2, 200/341, 345
See application file for complete search history.

(56) References Cited

U.S. PATENT DOCUMENTS 5,280,145 A * 1/1994 Mosier et al. ..... 200/313
5,495,393 A * 2/1996 Inoue et al. ..... 361/752
6,229,104 B1 * 5/2001 Matsui ..... 200/4
6,541,724 B2 * 4/2003 Nozawa et al. ..... 200/517
6,835,906 B2 * 12/2004 Okamoto et al. ..... 200/341
6,894,240 B2 * 5/2005 Komoto et al. ..... 200/512
6,971,807 B2 * 12/2005 Tsai et al. ..... 400/472
7,045,722 B2 * 5/2006 Tsai ..... 200/5 R
7,046,136 B2 * 5/2006 Sugimoto et al. ..... 340/539.1

* cited by examiner

*Primary Examiner*—Michael A. Friedhofer
(74) *Attorney, Agent, or Firm*—Birch, Stewart, Kolasch & Birch, LLP

(57) ABSTRACT

A noise reduction key structure is disclosed. The noise reduction key structure is applied to an electronic device having a housing and a substrate, the substrate being installed in the housing, the housing having a key portion, the noise reduction key structure comprising: a switch element which is installed on the substrate in response to the key portion; and an encapsulation which has a hole, wherein the hole encapsulates on the up side of the substrate, so that the substrate and the encapsulation together encapsulate the switch element into a chamber of the encapsulation, whereby when the key portion is pressed down, the key portion triggers the encapsulation to further trigger the switch element, and the encapsulation can reduce the noise of triggering the switch element.

21 Claims, 7 Drawing Sheets

NOISE REDUCTION KEY STRUCTURE

BACKGROUND OF THE INVENTION (1) Field of the Invention

The invention relates to a key structure, and more particularly, to a noise reduction key structure that can reduce noise of triggering keys (2) Description of the Prior Art In modern life, there are many kinds of electronic produces that are widely used by people, and people usually operate these electronic produces through various interfaces, for example, keyboards, mice, touch panel, and hand-writing board. In daily life, the most widely input device in the electronic produces is keyboards. Nowadays, computers still use pressing keyboards, moving mice, and touching panels to control inputs.

First, please refer to FIG. 1 which shows a key structure in the prior art. As shown in FIG. 1, an electronic device 1 has a housing 11, a substrate 12, and two key structures 10*a*, 10*b*, wherein the housing 11 has two key openings 110*a*, 110*b*, the key structure 10*a* includes a switch element 14*a* and a key portion 13*a*, the key structure 10*b* includes a switch element 14*b* and a key portion 13*b*. Accordingly, the electronic device 1 in the FIG. 1 is a structure that shows a part of touch board of a notebook computer, and the substrate 12 is a printed circuit board.

The switch element 14*a*, 14*b* are mounted on the substrate 12, the key portions 13*a*, 13*b* are respectively mounted in the key openings 110*a*, 110*b*, and are exposed to outside. The key portions 13*a*, 13*b* have an elastic restoration force. When the up sides of the key portions 13*a*, 13*b* are pressed, then down sides the key portions 13*a*, 13*b* will trigger the switch elements 14*a*, 14*b*. When the up sides of the key portions 13*a*, 13*b* are not pressed, then the key portions 13*a*, 13*b* will return to their original positions through the elastic restoration force.

However, when triggering the key structures 10*a* and 10*b*, there is a noise that bothers people. The noise is from an inner structure of the switch elements 14*a*, 14*b*. Because the switch elements 14*a*, 14*b* are different from each other, the reasons that cause the noise are different. The following will take tact switches for example to find out the reasons that cause the noise.

Please refer to FIG. 2 which shows a structure of a switch element 14. As shown in FIG. 2, the switch element 14 includes a key cap 141, a metal piece 142 and a pedestal 143. The pedestal 143 has a first electrode 151 and two second electrodes 152*a*, 152*b*. The metal piece 142 is an O-shaped electrical conductive piece, and covers an inner of the pedestal 143, and the key cap 141 is installed on the metal piece 142.

Again, please refer to FIGS. 3A and 3B, both of which show a sectional views of the switch element 14 in FIG. 2. As shown in FIG. 3A, the switch element 14 is not triggered yet, and the first electrode 151 and second electrode 152*a*, 152*b* are not electrically conductive yet. As shown in FIG. 3B the switch element 14 is triggered, the key cap 141 is pressed down by an external force. At that time, down edge of the key cape 141 will exert a force on an up side of the metal piece 142 to make the metal piece 142 deform, and further make the first electrode 151 and these two electrodes 152*a*, 152*b* electrically conductive. When the force that is exerted on the upper side of the key cap 141 is removed, then the metal piece will return back to its original O-shaped through the elastic restoration force, and thus the key cap 141 will return back to its original position, too.

The noise is produced during the time of deformation process of the metal piece 142; moreover, the electronic device 1 is a close space which can be a resonance space that can produce resonance, and further amplify such a noise.

The noise from the switch element 14 can be obviously observed in notebook computers and mice, because computers and their peripherals are needed by modern people in work and leisure time, and people always click and input through triggering keys, so that the noise can make the user and people who surround the user upset. Therefore, how to utilize material and various structure to further reduce and even eliminate such a noise is a top priority for research and development engineers to solve, so that user who uses the electronic device 1 and people who surround the user cannot be bothered by the noise.

SUMMARY OF THE INVENTION

It is an object of the present invention to provide a noise reduction key structure which can dramatically reduce the noise of triggering the keys.

The noise reduction key structure disclosed in the present invention is applied to an electronic device which has a housing and a substrate, wherein the substrate is installed in the housing, and the housing has a key portion. The noise reduction structure includes a switch element and an encapsulation. The switch element is installed on the up side of a substrate. The encapsulation has a hole which encapsulates on the up side of the substrate. The substrate and the encapsulation together encapsulate the switch element in a chamber of the encapsulation.

The embodiment of the present invention further discloses a noise reduction key structure which is applied to an electronic device that has a housing and a substrate, wherein the substrate is installed in the housing, and the housing has a key opening. The noise reduction key structure includes a switch element, an encapsulation and a key portion. The switch element is installed on the substrate in response to the key opening, the encapsulation has a hole which encapsulates on the up side of the substrate. The substrate and the encapsulation together encapsulate the switch element in the chamber of the encapsulation.

When the key portion is pressed down, then the down side of the key portion will trigger the encapsulation, so that the encapsulation is deformed to further trigger the switch element, and the encapsulation can reduce the noise of triggering the switch element. Accordingly, When the switch element is triggered, the noise that bothers people will be produced, for example, triggering the switch element. And the substrate can be a printed circuit board.

Again, the noise reduction key structure further includes a fastener which is installed on the up side of the substrate, the encapsulation has an engagement portion that can match with the fastener. Through the engagement portion and the fastener, both of which can engage with each other, the encapsulation can be indirectly mounted on the substrate.

The present invention further discloses a method for manufacturing the noise reduction key structure, which method includes the steps of: providing a substrate; installing a switch element on a up side of the substrate; providing an encapsulation that encapsulates the up side of the substrate; and encapsulating the switch element in a chamber of the encapsulation.

The encapsulation disclosed in the present invention is made of flexible material, for example, rubber material, or thermoplastic flexible material. Through encapsulating the switch element into the chamber of the encapsulation using the encapsulation and the substrate, the effects of noise isolation and noise absorption can be achieved. When triggering the switch element, the noise can be isolated in the chamber of the encapsulation, so that when user triggers the key portion, then the user and the people who surround the user can be prevented from being bothered by the noise of the operation.

BRIEF DESCRIPTION OF THE DRAWINGS

The present invention will now be specified with reference to its preferred embodiment illustrated in the drawings, in which.

DESCRIPTION OF THE PREFERRED EMBODIMENTS

Figure 4:
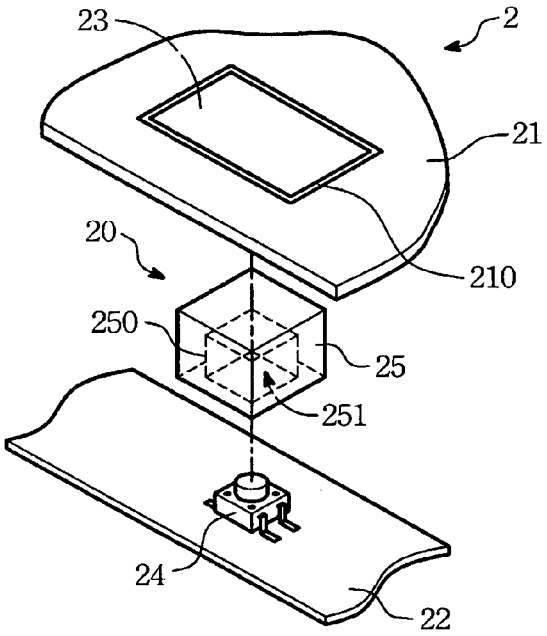
FIG. 4 is a structure view of the first embodiment of the noise reduction key structure of the present invention.

First, please refer to FIG. 4 which shows the system schematic drawing of a noise reduction key structure of the first embodiment of the present invention. As shown in FIG. 4, a noise reduction key structure 20 is installed in an electronic device 2. The electronic device 2 has a housing 21 and a substrate 22. The substrate 22 is installed in the housing 21. The housing has a key opening 210 and a key portion 23 which is installed in the key opening 210. The noise reduction key structure 20 has a switch element 24, an encapsulation 25.

Figure 1:
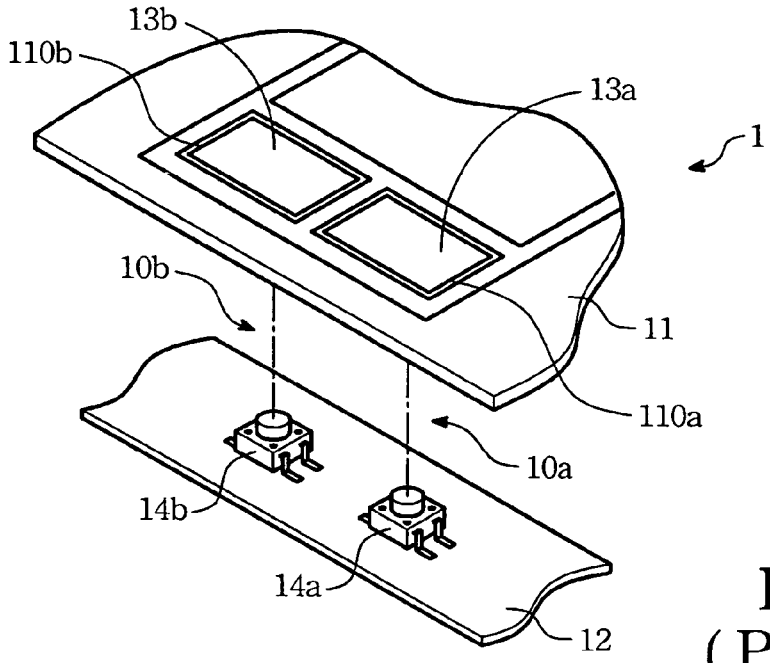
Fig. 1 (Prior Art)
FIG. 1 shows a key structure in the prior art.
Figure 2:
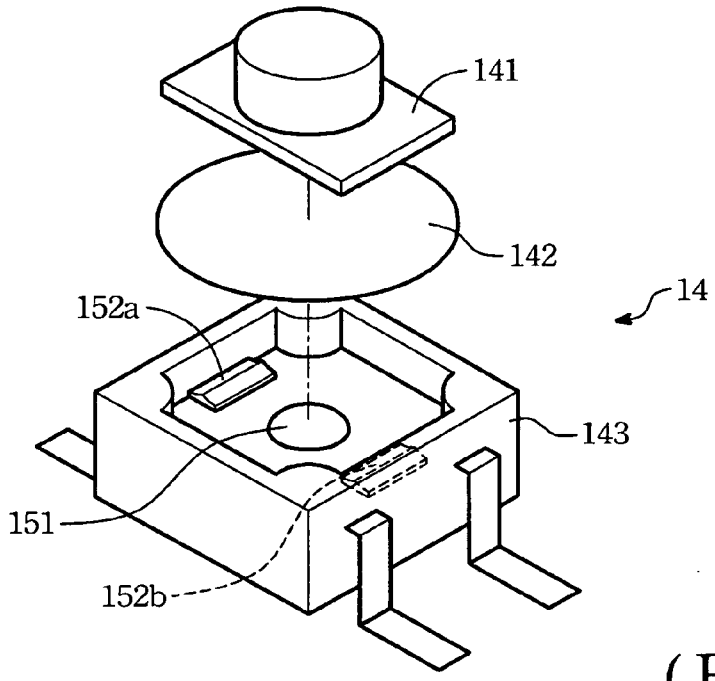
Fig. 2 (Prior Art)
FIG. 2 is a drawing which shows a switch element.
Figure 3A:
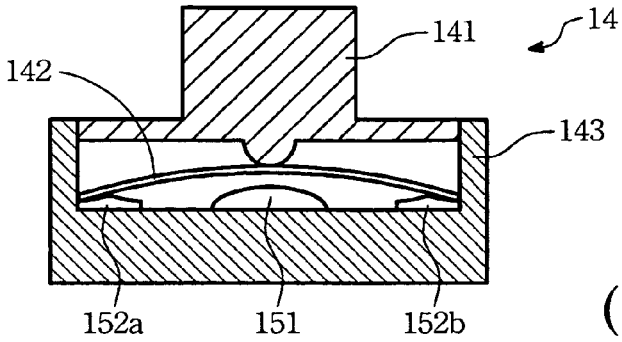
Fig. 3A (Prior Art)
FIGS. 3A and 3B are sectional views of the switch element.
Figure 3B:
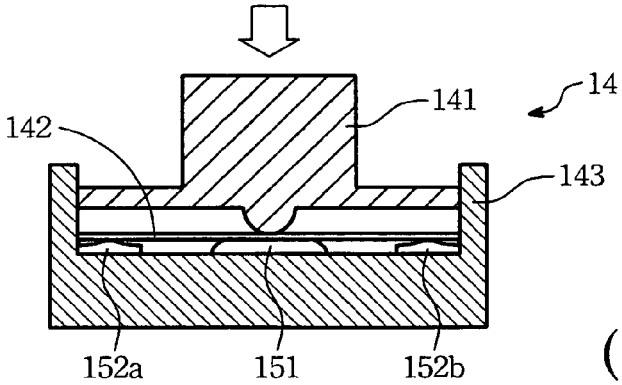
Fig. 3B (Prior Art)

The electronic device 2 can be an audio/video device, a mobile communication device, a notebook computer, a desktop computer, or a computer peripheral, for example, liquid crystal display (LCD) and mouse. The substrate 22 can be a circuit board, and when the switch element 24 is triggered, a noise, for example, touching the switch element, which noise can make people upset, is produced, as shown in FIG. 2. When a key cap 141 is triggered and is pressed again a metal piece 142, or is released, the metal piece will deform, and thus produce the noise.

Please refer to FIG. 4, the switch element 24 is installed on the up side of the substrate 22 in response to the key portion 23 and the key opening 210 that. The encapsulation 25 is an elastic empty-centered body with a hole 251. The opening 251 encapsulates on the up side of the substrate 22. The substrate 22 and the capsulation 25 together encapsulate the switch element into a chamber 250 of the encapsulation 25. The key portion 23 can be a part of the housing 21 and is installed in the key opening 210. The key portion can be independent from the housing 21, thus can be a part of the noise reduction key structure, can be installed on the encapsulation 25, and can be exposed to the outside through the key opening 210.

Figure 5A:
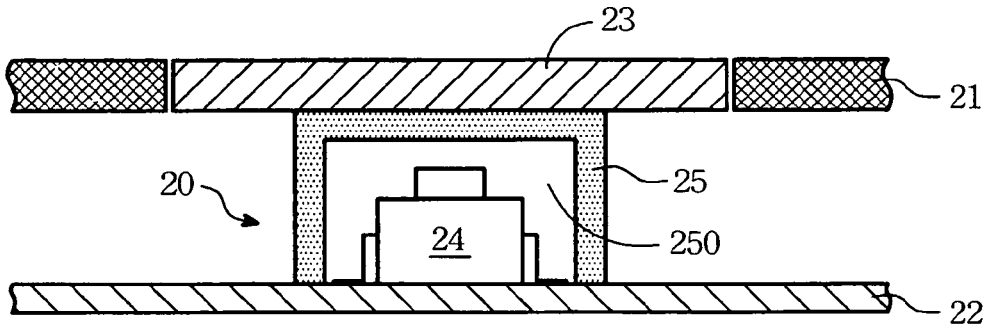
FIGS. 5A and 5B are sectional views of the first embodiment of the noise reduction key structure of the present invention.
Figure 5B:
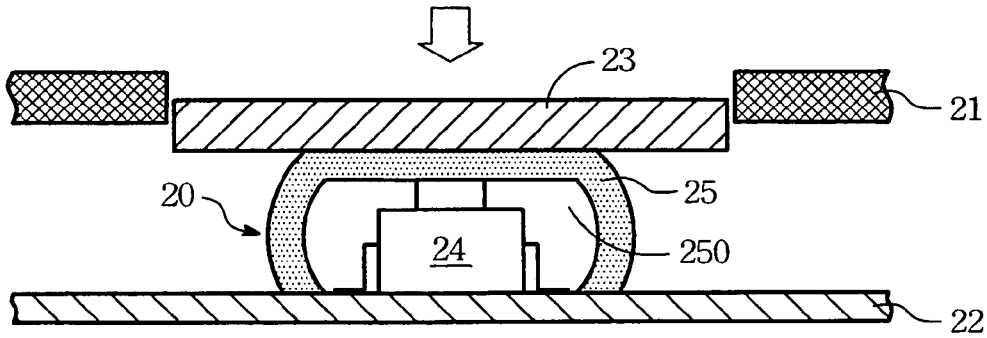

Again, please refer to FIGS. 5A and 5B, both of which are sectional views of the noise reduction key structure of the first embodiment of the present invention. FIG. 5A shows the key portion 23 that has not been triggered yet, while FIG. 5B shows the key portion 23 that has been triggered. As shown in FIG. 5B, when the up side of the key portion 23 is pressed down, then the down side of the key portion 23 will touch the encapsulation 25, and thus make the encapsulation 25 deform, to further trigger the switch element 24. The encapsulation 25 can reduce the noise of triggering the switch element 24.

The encapsulation 25 is made of an elastic material which can be a rubber material or thermoplastic elastic composite material. According to the properties of aforesaid materials, the encapsulation can be produced through a press forming method or a plastic injection method. Because the switch element 24 is encapsulation in the chamber 250, the encapsulation 25 can have an good effect on properties of noise isolation or noise absorbing, thus the noise of triggering the switch element 24 can be isolated in the chamber 250, and therefore, the noise of triggering that spreads out of the encapsulation 25 can be effectively reduced.

The encapsulation can be mounted on the substrate 22 through a adhesive agent. However, in addition to the adhesive agent, the aforesaid purpose of being mounted on the substrate can be achieved by other methods. Please refer to FIGS. 6A and 6B, wherein FIG. 6A shows a structure view of the noise reduction key structure of a second embodiment of the present invention, while FIG. 6B is a sectional view of the noise reduction key structure of the second embodiment of the present invention.

Figure 6A:
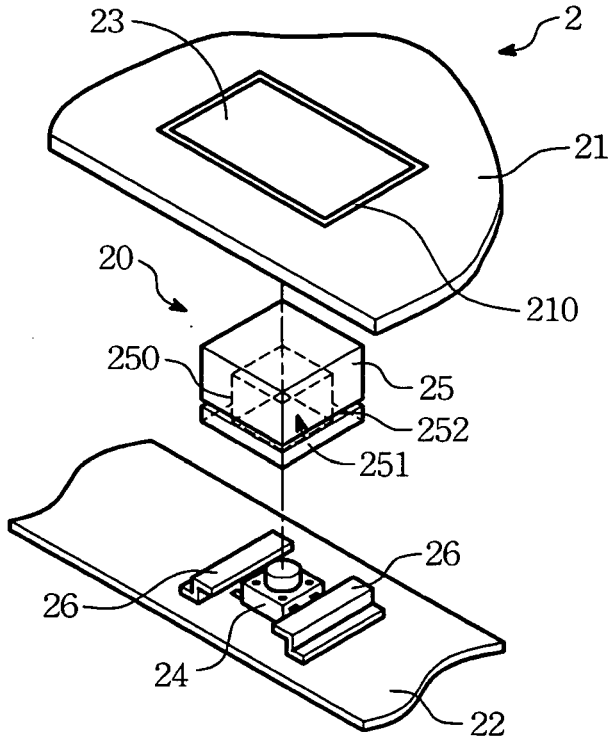
FIG. 6A is a structure view of the second embodiment of the noise reduction key structure of the present invention.
Figure 6B:
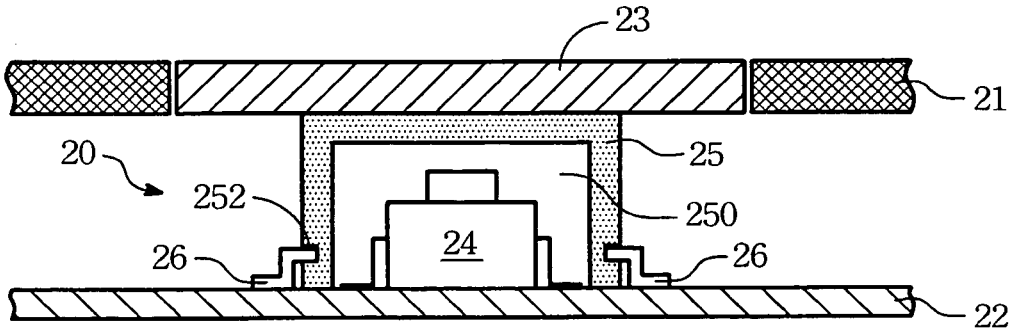
FIG. 6B is a sectional view of the second embodiment of the noise reduction key structure of the present invention.

As shown in FIG. 6A, the noise reduction key structure 20 includes a fastener 26. The fastener 26 is mounted on the up side of the substrate. The encapsulation 25 has an engagement portion 252 which can engage with the fastener 26. Through the engagement between the fastener 26 and the engagement portion 252, the encapsulation 25 can be indirectly mounted on the substrate 22.

The fastener 26 can be mounted on the up side of the substrate 22 through adhesive, press or welding methods. In addition, in FIGS. 6A and 6B, the fastener 26 is two symmetric S-shaped, which is taken for example, but not limits the scope of the present invention.

Figure 7A:
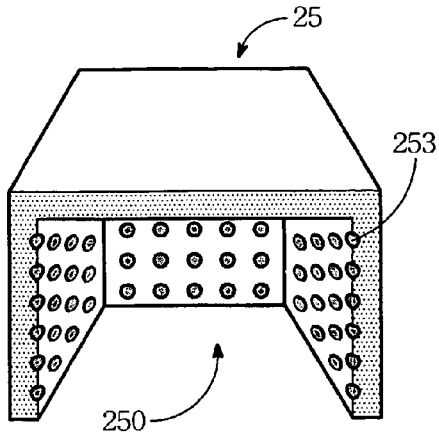
FIGS. 7A, 7B, 7C, and 7D are sectional views of an encapsulation disclosed in the present invention.
Figure 7B:
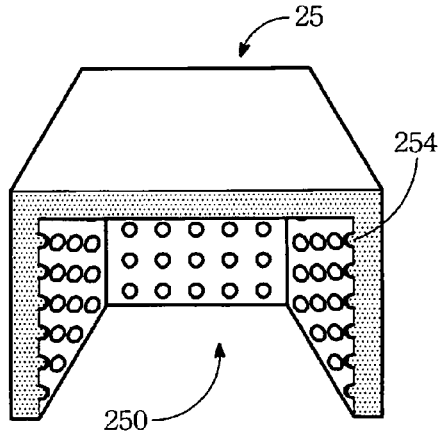
Figure 7C:
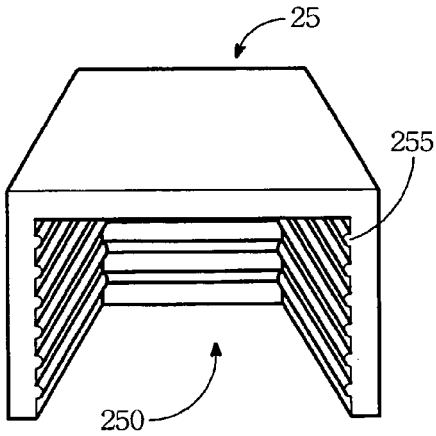
Figure 7D:
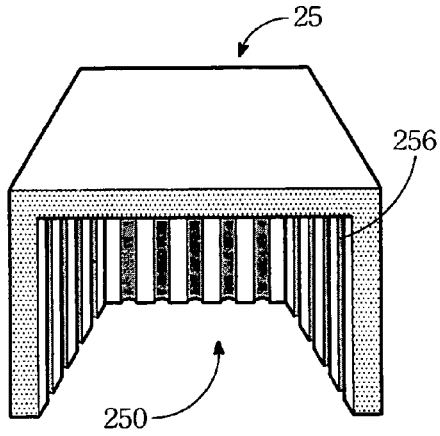

In addition, surface of the chamber 250 of the encapsulation 25 can has a special pattern, to further reduce the noise of triggering the switch element 24. Please refer to FIG. 7A, 7B, 7C, 7D, all of which show section views of the encapsulation disclosed in the present invention. As shown in FIG. 7A, the surface of the chamber 250 can be provided with a plurality of tiny holes 253. As shown in FIG. 7B, the surface of the chamber 250 can be provided with a plurality of dots 254. As shown in FIG. 7C, the surface of the chamber 250 can be provided with a plurality of ribs. As shown in FIG. 7C, the surface of the chamber 250 can be provided with a plurality of grooves.

Figure 8:
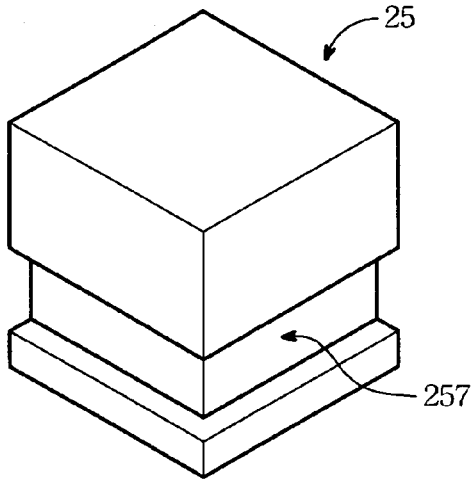
FIG. 8 is a perspective view of the encapsulation having thickness of the first embodiment of the present invention.

Again, please refer to FIG. 8, which is a perspective view of the encapsulation with thickness, of the first embodiment of the present invention. As shown in FIG. 8, the encapsulation 25 has a thickness. The thickness is easily deformed, to facilitate the encapsulation 25 to be pressed down and to trigger the switch element 24.

Figure 9A:
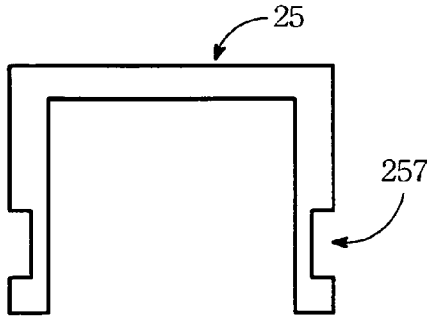
FIGS. 9A and 9B are sectional views of the encapsulation having thickness of the first embodiment of the present invention.
Figure 9B:
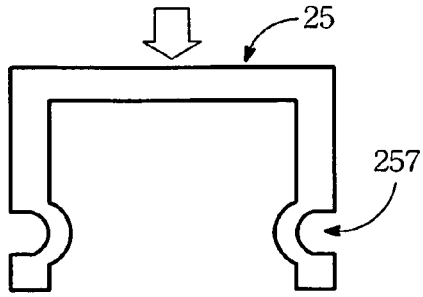

Please refer to FIGS. 9A and 9B, both of which are section views of the encapsulation with thickness, of the first embodiment of the present invention. FIG. 9A shows the encapsulation 25 that has not been deformed yet, while FIG. 9B shows the encapsulation 25 that is pressed down and that is deformed. As shown in FIG. 9B, the encapsulation 25 is pressed down by an external force, and thus the thickness 257 is deformed in response to the external force, so that the material fatigue of the encapsulation 25 can be improved.

The appearance of the encapsulation 25 can be sphere, polygon, and other shapes. However, the encapsulation 25 in the figures is taken cubic for example, but not limits the scope of the present invention.

The present invention further discloses a method for manufacturing a noise reduction key structure, wherein the noise reduction key structure 20 is applied to the electronic device 2 with the housing 21 and the substrate 22. The housing 22 has at least one key opening 210. Please refer to FIG. 10 which is flowchart showing the steps of the method for manufacturing the noise reduction key structure of the first embodiment of the present invention.

Figure 10:
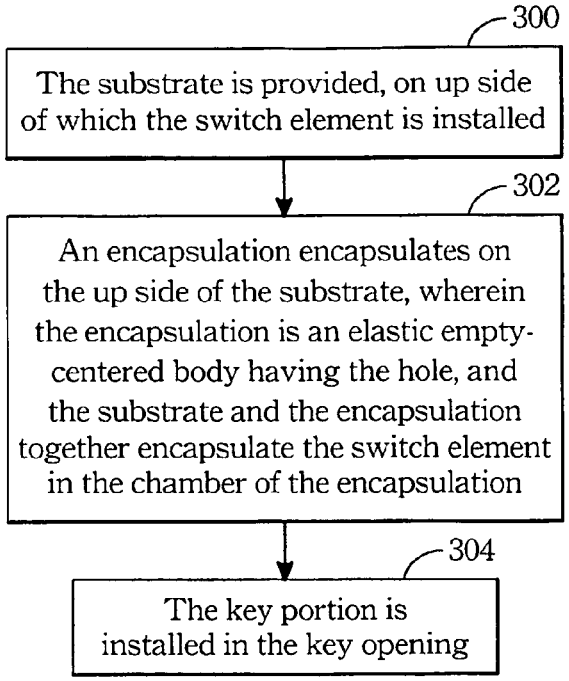
FIG. 10 is a flowchart which shows the steps of the method for manufacturing the noise reduction key structure of the first embodiment of the present invention.

As shown in FIG. 10, the method includes the steps of: providing the substrate, on up side of which the switch element 24 is provided (s300); the encapsulation 25 encapsulating on the up side of the substrate, wherein the encapsulation 25 is an elastic empty-centered body with a hole 251, and the substrate 22 and the encapsulation 25 together encapsulate the switch element 24 in the chamber 250 of the encapsulation 25(s302); and installing the key portion 23 in the key opening 210(s304).

In step (s302), the encapsulation 25 is mounted on the up side of the substrate 22 through adhesive method or engagement method. The adhesive method uses an adhesive agent to glue between the encapsulation 25 and the substrate 22, so that the encapsulation 25 can be mounted on the substrate 22. In addition, the noise reduction key structure 20 can also have the fastener 26. The fastener 26 is mounted on the up side of the substrate 22. The encapsulation 25 can engage with the fastener 26 through the engagement portion 252, to further be mounted on the substrate 22.

Figure 11:
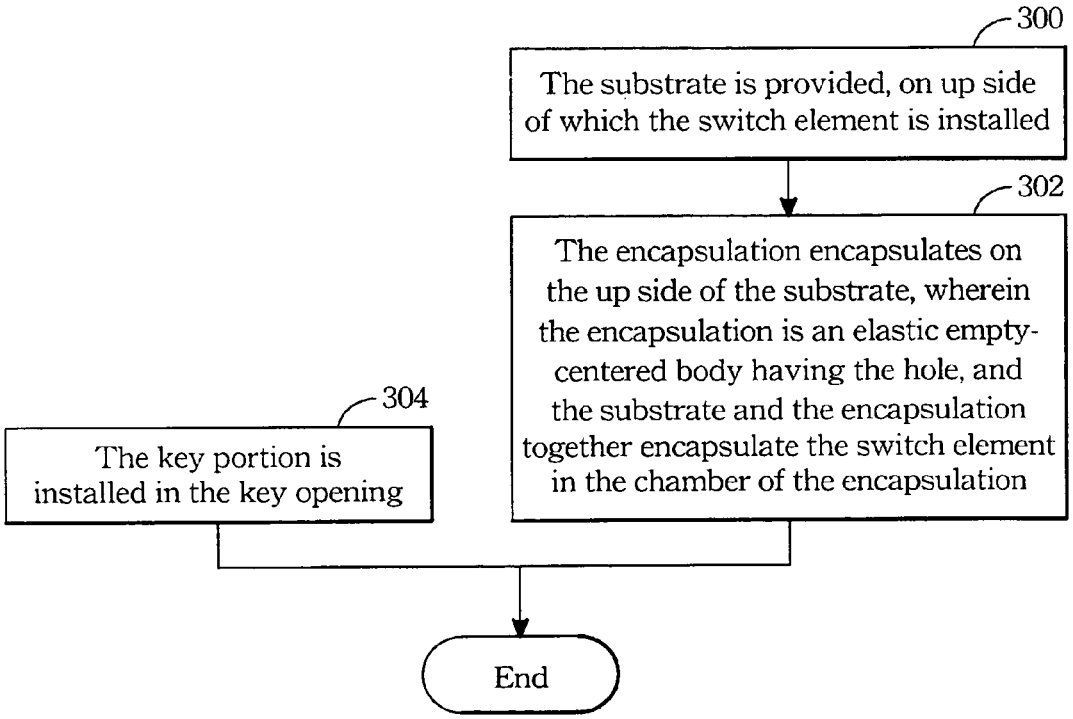
FIG. 11 is a flowchart which shows the steps of the method for manufacturing the noise reduction key structure of the second embodiment of the present invention.

Please refer to FIG. 11 which is a flowchart of steps of the noise reduction key structure of the second embodiment of the present invention. As shown in FIG. 11, the substrate 22 is provided, on up side of which the switch element 25 is installed(s300). The encapsulation 25 encapsulates on the up side of the substrate 22, wherein the encapsulation 25 is an elastic empty-centered body having the hole 251, and the substrate 22 and the encapsulation 25 together encapsulate the switch element 24 in the chamber 250 of the encapsulation 25(s302). On the other hand, The difference between FIG. 10 and FIG. 11 is that the key portion 23 can be installed in the key opening 210 (s304).

The perspective views and sectional views of the aforesaid noise reduction key structure 20 have been shown in FIG. 4, FIG. 5A, FIG. 5B, FIG. 6A, and FIG. 6B. The detailed descriptions thereof are omitted here.

Through the fact that the noise reduction key structure 20 encapsulates the switch element 24 in the encapsulation 25, and through the properties of the noise isolation and noise absorption of the encapsulation 25, the noise of triggering the switch element 24 can be effectively reduced, so that the user who operates the electronic device 2 and the people who surround the user will not be bothered by the noise of triggering the switch element 24.

While the present invention has been particularly shown and described with reference to a preferred embodiment, it will be understood by those skilled in the art that various changes in form and detail may be without departing from the spirit and scope of the present invention.

We claim:

1. A noise reduction key structure which is applied to an electronic device having a housing and a substrate, the substrate being installed in the housing, the housing having a key portion, the noise reduction key structure comprising:

a switch element which is installed on the substrate in response to the key portion; and an encapsulation which has a hole, wherein the hole encapsulates on an up side of the substrate, so that the substrate and the encapsulation together encapsulate the switch element into a chamber of the encapsulation, wherein a surface of the chamber of the encapsulation has a special pattern to further reduce the noise of triggering the switch element, whereby when the key portion is pressed down, the key portion triggers the encapsulation to further trigger the switch element.

2. The key structure according to claim 1, wherein the encapsulation is made of a rubber material or a thermoplastic elastic composite material.

3. The key structure according to claim 1, wherein the special pattern is a plurality of tiny holes, a plurality of dots, a plurality of grooves, or a plurality of ribs.

4. The key structure according to claim 1, wherein a thickness is provided on an edge of the encapsulation, and the thickness is deformed, to facilitate the encapsulation to be pressed down and to trigger the switch element.

5. The key structure according to claim 1, wherein the encapsulation is mounted on the up side of the substrate using an adhesive agent.

6. The key structure according to claim 1, further comprising a fastener which is installed on the up side of the substrate to mount the encapsulation on the substrate.

7. The key structure according to claim 1, wherein the switch element is a tactile switch.

8. The key structure according to claim 1, wherein the substrate is a circuit board.

9. The key structure according to claim 1, wherein the encapsulation is an elastic empty-centered body.

10. A noise reduction key structure which is applied to an electronic device having a housing and a substrate, the substrate being installed in the housing, the housing having a key opening, the noise reduction key structure comprising:

a switch element which is installed on the substrate in response to a key portion;

an encapsulation which has a hole, wherein the hole encapsulates on an up side of the substrate, so that the substrate and the encapsulation together encapsulate the switch element into a chamber of the encapsulation, wherein a surface of the chamber of the encapsulation has a special pattern to further reduce the noise of triggering the switch element; and a key portion which is installed in the key opening, whereby when the key portion is pressed down, the key portion triggers the encapsulation to trigger the switch element.

11. The key structure according to claim 10, wherein the encapsulation is made of a rubber material or a thermoplastic elastic composite material.

12. The key structure according to claim 10, wherein the special pattern is a plurality of tiny holes, a plurality of dots, a plurality of grooves, or a plurality of ribs.

13. The key structure according to claim 10, wherein a thickness is provided on an edge of the encapsulation, and the thickness is deformed, to facilitate the encapsulation to be pressed down and to trigger the switch element.

14. The key structure according to claim 10, wherein the encapsulation is mounted on the up side of the substrate using an adhesive agent.

15. The key structure according to claim 10, further comprising a fastener which is installed on the up side of the substrate to mount the encapsulation on the substrate.

16. The key structure according to claim 10, wherein the switch element is a tactile switch.

17. The key structure according to claim 10, wherein the substrate is a circuit board.

18. The key structure according to claim 10, wherein the encapsulation is an elastic empty-centered body.

19. A method for manufacturing a noise reduction key structure, comprising the steps of:

(a) providing a substrate, on an up side of which a switch element is provided; and (b) an encapsulation encapsulating on the up side of the substrate, wherein the encapsulation is an elastic empty-centered body having a hole, and the substrate and the encapsulation together encapsulate the switch element in a chamber of the encapsulation, wherein a surface of the chamber of the encapsulation has a special pattern to further reduce the noise of triggering the switch element.

20. The method according to claim 19, wherein in step (b), the encapsulation is mounted on the up side of the substrate using adhesive method or engagement method.

21. The method according to claim 19, wherein the noise reduction structure is applied to an electronic device having a housing and a substrate, the housing has at least one key opening, and the method further comprises a key portion which is installed in the key opening.

* * * * *